United States Patent [19]

Myklebust et al.

[11] 4,356,783

[45] Nov. 2, 1982

[54] PORTABLE MOORING WHIP UNIT

[76] Inventors: Terje Myklebust; David P. Murphy, both of 7851 Dunham Blvd., #10, Miami, Fla. 33138

[21] Appl. No.: 137,400

[22] Filed: Sep. 18, 1980

[51] Int. Cl.[3] ..... B63B 21/08

[52] U.S. Cl. ..... 114/230; 114/364

[58] Field of Search ..... 9/1.1, 1.7, 7; 211/60 R, 60 G, 60 T, 62, 63, 64, 65; 114/230, 253, 218, 270, 221 R, 343, 364, 363

[56] References Cited

U.S. PATENT DOCUMENTS

| | | | |
|---|---|---|---|
| 2,956,531 | 10/1960 | Banker | 114/230 |
| 2,974,329 | 3/1961 | Welch | 9/1.1 |
| 3,196,824 | 7/1965 | Howard | 114/230 |
| 3,602,188 | 8/1971 | Penaflor | 114/253 |
| 3,851,613 | 12/1974 | Armour | 114/230 |
| 4,221,014 | 9/1980 | Davidson | 9/1.1 |

*Primary Examiner*—Trygve M. Blix
*Assistant Examiner*—Jesús D. Sotelo
*Attorney, Agent, or Firm*—John Cyril Malloy

[57] ABSTRACT

A portable mooring whip unit for mounting and transporting a mooring whip comprising a housing including a face plate having at least one aperature centrally located within the face plate. The unit includes a tubular member for each centrally located aperature having a first end connected to the aperature and a second end either extending upwardly from the aperature or downwardly depending upon the embodiment. The second end may be closed or open again depending upon the embodiment described herein. The face plate fixably connected to the deck surface with a screw structure or other similar structure and including a backing plate connected to the underside of the deck wherein the screw structure may be threaded to the face plate and the backing plate connecting the two thereto through use of bolt structures or other similar structures. The mooring whip unit including a mooring whip inserted into the apertures and tubular members and stored therein for transport and usage.

6 Claims, 8 Drawing Figures

PORTABLE MOORING WHIP UNIT

FIELD OF THE INVENTION

This invention relates generally to a structure for securing a boat to a dock or pier and, more specifically, to a device which allows greater flexibility in the use of mooring whips for securing a boat to said pier or dock.

BACKGROUND OF THE INVENTION

Mooring whips have in the past been utilized as a means for preventing a water vehicle from striking a dock or pier by offsetting wave action or other forces which would tend to force the vehicle against its mooring. In this manner, damage to the boat is prevented and mooring whips have been found in the past to be of great use in said purpose.

The applicant's invention relates to a mooring whip being stored within the boat itself. While is is not new for a docking line to be stored on a boat for attachment to a dock or a pier, See U.S. Pat. Nos. 3,129,688 and 3,851,613, applicant has invented a device wherein a mooring whip line may be stored on a boat without the need of having to search for a place to either find the mooring whips or an appropriate structure for docking at a pier such as the structure illustrated in U.S. Pat. No. 4,040,377.

It has been found that persons desirous of using mooring whips have often great difficulty in using the same because the mooring whips and/or holders are generally not available when a boater desires to dock his boat. Additionally, if a boater decides to dock his boat at a remote place, it has been found by applicant that mooring whip holders are not generally available. Thus, a boater desirous of using a mooring whip for the purpose more fully set forth hereinafter is left to find his own means for attaching the mooring whip to the dock and a suitable connect on mean, such as that found in U.S. Pat. No. 4,040,377. It thusly necessitates a person desirous of using said mooring whips to carry a device such as U.S. Pat. No. 4,040,377 along with him at such time. Applicant has eliminated the need for carrying such a device and has designed a device wherein the mooring whip may be carried by the boat and the means for connection to the dock may be of a simple staple means or other commonly found means which may be easily carried along with the boater or other commonly found means which are generally found on most docks.

As can be seen by the representative structures which have been cited above, there have been a relative paucity of structures which are designed to make it more flexible and easier to use a mooring whip at various times. Applicant has invented a device wherein the mooring whip may be used in almost all possible situations as a result of the portable nature of the mooring whip with the structure described more fully hereinafter.

BRIEF DESCRIPTION OF THE INVENTION

A portable mooring whip unit for mounting and transporting a mooring whip. The unit comprises a housing including a face plate having an aperture centrally located within the face plate, the face plate may have more than one aperture. A tubular member for each aperture having an open first end connected to the aperture and a second end either extending upwardly from the aperture or downwardly depending on the user's need. The second end may be closed or open, again depending on the user's need. Of course, in the upwardly extending tubular member embodiment the second end will be open. The face plate is fixedly connected to the deck surface with screw means or other like or similar means and the housing may include a backing plate on the underside of the deck wherein the screw means are threaded to the face plate and the backing plate and are connected thereto by bolt means or other similar means. The mooring whip may then be inserted into the apertures and tubular members and stored therein for transport and usage.

DESCRIPTION OF THE PREFERRED EMBODIMENT

Figure 1:
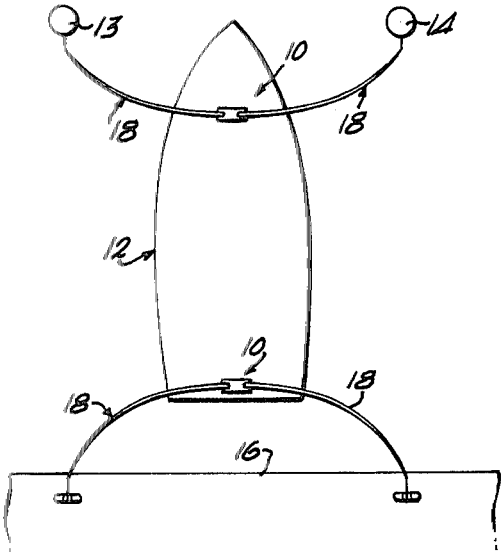
FIG. 1 is a top plan view of the invention showing one embodiment having dual connection members.

Referring to the drawings wherein like reference characters may designate like or corresponding parts and referring particularly to FIG. 1, there is shown one embodiment of the invention generally designated by the numeral 10. In this embodiment there is a dual connection for the mooring whip as can be seen by the Figure. The boat generally designated by the numeral 12 is connected to piers or stranchions 13 and 14 and to a dock 16 by four mooring whips generally designated by the numeral 18. In this manner the boat is held securely against wave movement to prevent the boat from contacting with either the piers or the dock to prevent damage to the boat.

Figure 2:
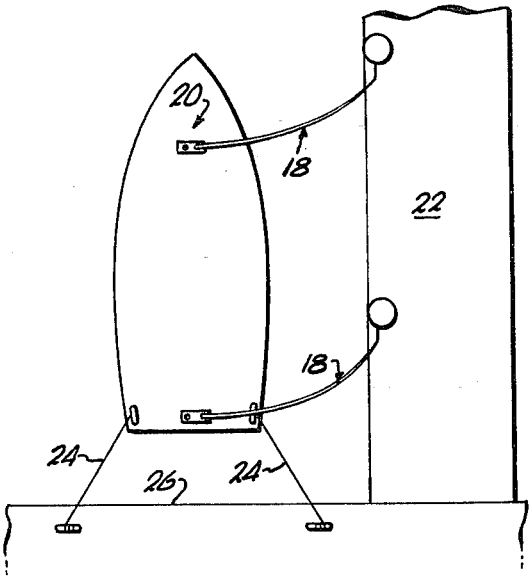
FIG. 2 is a second embodiment of the invention showing single connections.
Figure 3:
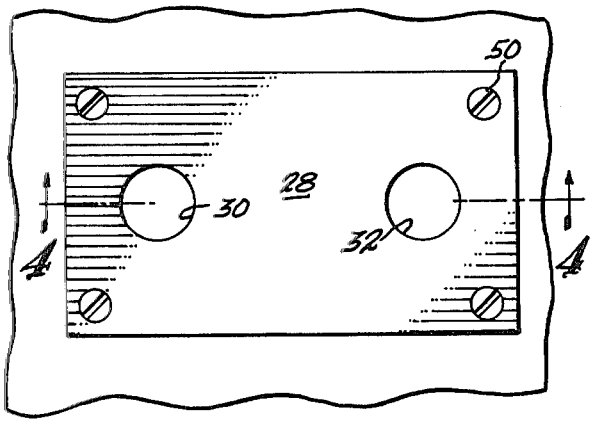
FIG. 3 is an enlarged view of the invention connected to the deck of a boat.
Figure 4:
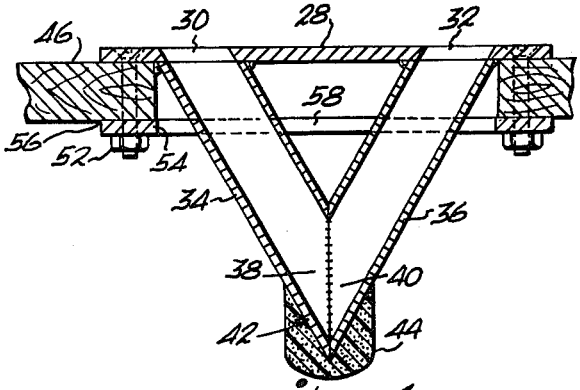
FIG. 4 is a cross sectional view of the invention taken along line 4—4 of FIG. 3.

Referring specifically to FIG. 2, there is shown another embodiment of the invention generally designated by the numeral 20 which is connected to a dock 22 by mooring whips 18. In this way the single mooring whip connecting device holds the boat away from the dock 22 and is secured by other lines 24 from another portion of the dock 26. The boat 12 is prevented from contacting the dock 22 through the mooring whips even in heavy wave action. Further, if wave action were to come from the stern to the bow, the mooring whips would also react to that and prevent the boat from contacting dock 26. Referring specifically to FIG. 3, there is shown the embodiment of the invention generally called a dual receptacle and designated by the numeral 10 which is pictured in use in FIG. 1. The invention, a portable mooring whip housing comprises a face plate 28 which includes at least one aperture and in the embodiment shown in FIG. 3 a pair of apertures 30 and 32. As shown in FIG. 4 the apertures are sized and shaped for connection with the mooring whip 18 as can be more acurately seen in FIGS. 1 and 2. The face plate includes tubular members such as those shown in FIG. 5 and generally designated 34 and 36. The tubular members 34 and 36 are connected to the face plate at the apertures 30 and 32 in the embodiment shown in FIGS. 1, 3, 4 and 5. The tubular members are cylinder-like having a first open end in open communication with the apertures and a second end 38 and 40 respectively, which form a V-shaped bottom portion generally designated by the numeral 42.

In the embodiment shown in FIGS. 1, 3, 4 and 5 the tubular members are shown to be downwardly extending. Of course, as will be appreciated by the person of ordinary skill, and particularly with reference to FIG. 8, there will be seen that this is not necessarily so and the tubular members may be upwardly extending. In the case where the tubular members are downwardly extending and there are dual members interconnecting as shown in FIG. 4 where the V joint 42 is formed, a safety means 44 may be applied to the V joint to prevent serious bodily injury to a user. Thus, if a user contacts the downwardly extending tubular members it will be on a safety means which will square off the sharply angulated V joint and as a result injury to the boater or user will be minimized.

The face plate is connected to the deck of a boat such as at 46 wherein the face plate includes holes such as at 48 which comprise openings for screw members 50. The holes may be self-tapping or as shown in FIG. 4 may include bolt means such as 52 which go on the underside of the deck. Thus, the face plate fits over a portion in a deck which has been sized and shaped for receipt of said face plate and housing wherein screw threads or holes have been drilled for receipt of screws such as at 50. In order to securely fasten the face plate and housing generally to the boat deck, a backing plate 54 may be applied to the underside of the deck 46 such as at 56. The screws may then be thead through the holes of the face plate and deck, the backing plate applied to the under surface 56 of the deck 46 and connected firmly thereto.

It has been found that the tubular members if angled from the horizontal at approximately 60 degrees give the best results. Thus, a force applied in any direction will continue to secure the boat from contact with either a pier, such as at 12 or 14, and dock, such as at 16, 22 or 26.

The deck surface may be of any type including wood or fiberglass among others which it is suitable to drill a hole through for receipt of the housing and drill further holes for receipt of screw means such as at 50 which may then be securely fastened to the deck.

It will be appreciated by one skilled in the art that self-tapping screw means may be used and that the addition of a backing plate is not necessary to accomplish the objects, functions and overall purpose of the invention.

Figure 5:
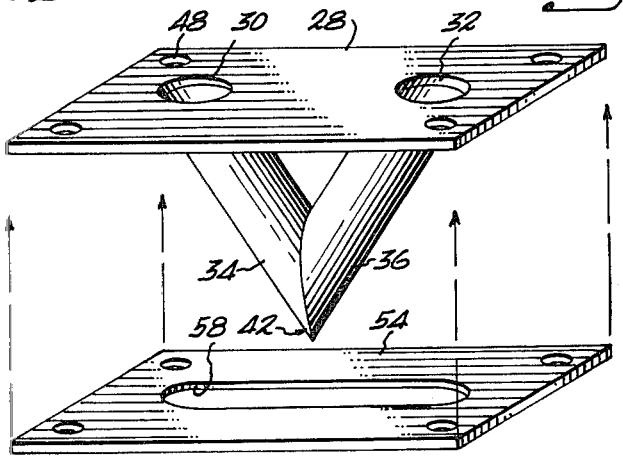
FIG. 5 is a perspective view of the invention showing a dual downwardly extending embodiment.
Figure 6:
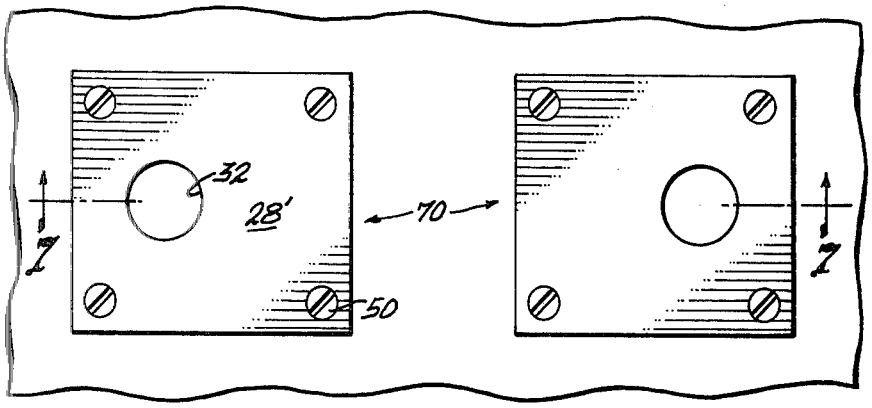
FIG. 6 is an enlarged top plan view of another embodiment of the invention showing single connecting members.
Figure 7:
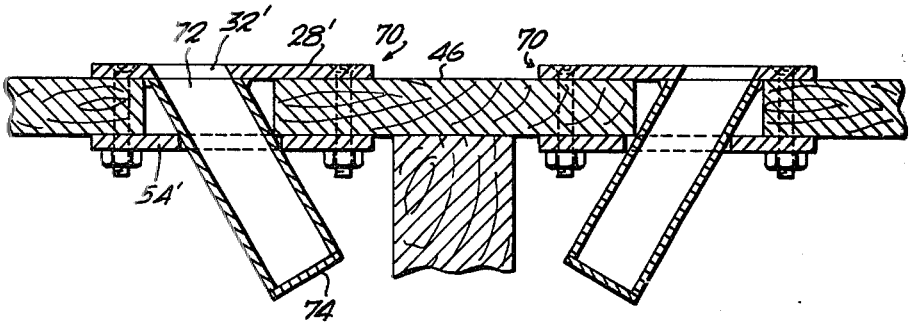
FIG. 7 is a cross sectional view of the embodiment of the invention shown in FIG. 6 taken along line 7—7 of FIG. 6.

Referring to the embodiment shown in FIG. 6 and generally designated by the numeral 70, there is shown pair of opposed single housing means which accept only one mooring whip per each housing. In general, the single mode is quite similar to the dual mode shown generally in FIG. 3 as seen in the structure designated generally at numeral 10. Each single housing means comprises a face plate 28' having an aperture 32'. As shown in FIG. 7 there is a tubular member having a first open end 72 connected to the face plate aperture 32' and a second closed end 74 downwardly extending from the deck 46 sized and shaped for receipt of a mooring whip 18. The face plate includes holes for accepting screw means such as at 50 similar to that of the embodiment shown in FIGS. 3, 4 and 5. Additionally, a backing plate 54' may be used as an additional means for securing the single mode housing to the deck of a boat.

Figure 8:
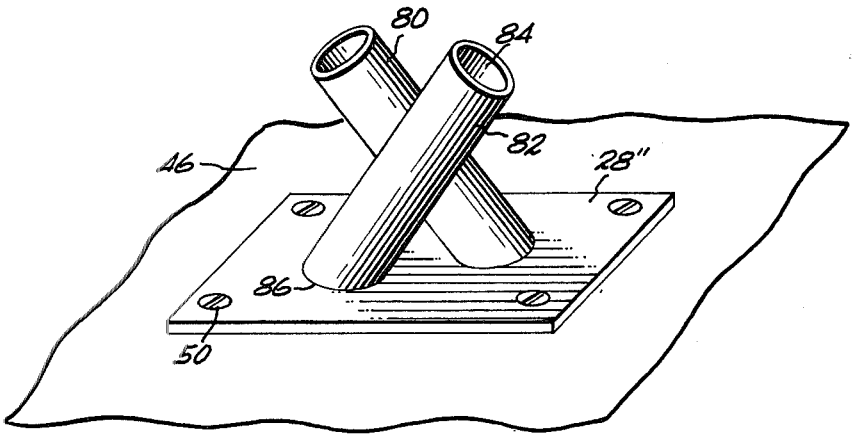
FIG. 8 is a fragmentary close-up perspective view of one embodiment of the invention showing a dual upwardly extending connection means.

FIG. 8 shows a perspective view of another embodiment of the invention wherein the tubular members 80 and 82 are upwardly extending from the face plate 28'' and the deck 46. In this embodiment the tubular members do not intercept at a V joint such as shown in FIG. 5 but, rather, criss-cross and include open first and second ends 84 and 86 respectively. Similar to the earlier embodiments, the face plate 28'' is connected to the deck surface through screw means 50 and include a backing plate such as 54, slotted as at 58, which may also be connected in a similar fashion to the earlier embodiments shown in FIGS. 1 through 7.

Again, it has been found that the optimum usage of the mooring whip securing it from contact with a deck or pier would be to have the tubular members angulated at approximately a 60 degree angle from the horizontal.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A portable mooring whip receptacle housing and a deck, said housing comprising:

a housing having a face plate, the face plate having a pair of apertures, each centrally located on the face plate and adjacent each other, the apertures being sized and shaped for receipt of a mooring whip, and means for captivating the mooring whip including a pair of cylinder-like tubular member having a first open end fixedly attached to the apertures of the face plate, and means for securing the housing to the deck of a water vehicle;

said face plate is mounted to the deck on a horizontal plane and each tubular member is mounted to the face plate at approximately a 60 degree angle from the horizontal plane of the deck and face plate connection;

said deck including an upper and a lower side and the means for securing the housing to the deck, said means for securing comprising:

the face plate connected to the upper side of the deck and a backing plate connected to the underside of the plate directly under the face plate, and means for connecting the two plates together with the deck sandwiched inbetween;

said tubular members being upwardly extending away from the deck;

said tubular members including a first open end each connected to their respective aperture, and a second closed end, the second closed ends of each of the tubular members joined such that a V joint is formed and the tubular members are not in open communication with one another.

2. The device as set forth in claim 1 wherein the V joint has a sharp angular bottom portion and a safety means is applied to the V joint bottom portion squaring off the sharp angulated bottom portion, thereby if a boater's head or other bodily part were to strike or otherwise contact the V joint, the injury sustained by the boater will be minimized.

3. A portable mooring whip receptacle housing and a deck, said housing comprising:

a housing having a face plate, the face plate having a pair of apertures, each centrally located and adjacent each other on the face plate, the apertures being sized and shaped for receipt of a mooring whip, and means for captivating the mooring whip including a pair of cylinder-like tubular member having a first open end fixedly attached to the apertures of the face plate, and means for securing the housing to the deck of a water vehicle;

said face plate is mounted to the deck on a horizontal plane, each tubular member is mounted to the face plate at approximately a 60 degree angle from the horizontal plane of the deck and face plate connection;

said tubular members including a first open end each connected to their respective aperture, and a second closed end, the second closed ends of each of the tubular members joined such that a V joint is formed and the tubular members are not in open communication with one another.

4. The device as set forth in claim 3 wherein the deck includes an upper and a lower side and the means for securing the housing to the deck comprises:

the face plate connected to the upper side of the deck and a backing plate connected to the underside of the plate directly under the face plate, and means for connecting the two plates together with the deck sandwiched inbetween.

5. The device as set forth in claim 4 wherein the tubular members are upwardly extending away from the deck.

6. The device as set forth in claim 4 wherein the tubular members are downwardly extending into the deck.

* * * * *